US008083543B2

(12) United States Patent
Omori et al.

(10) Patent No.: US 8,083,543 B2
(45) Date of Patent: Dec. 27, 2011

(54) JOINT CONNECTOR AND WIRE SHORT-CIRCUITING METHOD USING THE SAME

(75) Inventors: Yasuo Omori, Yokkaichi (JP); Hiroki Hirai, Yokkaichi (JP); Tetsuji Tanaka, Yokkaichi (JP); Tatsuo Tamagawa, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/733,596

(22) PCT Filed: Dec. 15, 2008

(86) PCT No.: PCT/JP2008/072761

§ 371 (c)(1),
(2), (4) Date: Mar. 10, 2010

(87) PCT Pub. No.: WO2009/078374

PCT Pub. Date: Jun. 25, 2009

(65) Prior Publication Data

US 2010/0203756 A1 Aug. 12, 2010

(30) Foreign Application Priority Data

Dec. 18, 2007 (JP) ..... 2007-326180

(51) Int. Cl.
*H01R 31/08* (2006.01)

(52) U.S. Cl. ..... 439/511; 439/595

(58) Field of Classification Search ..... 439/511, 439/507, 510, 189
See application file for complete search history.

(56) References Cited

U.S. PATENT DOCUMENTS 5,201,667 A * 4/1993 Endo et al. ..... 439/189
(Continued)

FOREIGN PATENT DOCUMENTS

JP U-04-027588 3/1992
(Continued)

OTHER PUBLICATIONS

International Search Report issued in International Application No. PCT/JP2008/072761; Mailed on Jan. 13, 2009 (With Translation).

*Primary Examiner* — Hien Vu
(74) *Attorney, Agent, or Firm* — Oliff & Berridge, PLC

(57) ABSTRACT

A joint connector capable of mutually short-circuiting wires reliably without an increase in the number of components and size thereof. The joint connector (JC) comprises a joint terminal for short-circuiting and a connector housing. The joint terminal includes a plurality of electric contact portions and a short-circuiting portion connecting the electric contact portions. The connector housing has a bottom wall and other walls surrounding a terminal insertion space into which each of the wire-side terminal is inserted, and a lance for locking the inserted wire-side terminal. The lance adapted to be deflected so as to project outwardly from the bottom wall, until the wire-side terminal reaches a proper insertion depth position, to be retracted from the wire-side terminal, and elastically return into the bottom wall, when the wire-side terminal reaches the position. The deflection of the lance allows the insertion of the wire-side terminal to be checked.

4 Claims, 17 Drawing Sheets

U.S. PATENT DOCUMENTS

| | | | | |
|---|---|---|---|---|
| 5,496,188 | A | 3/1996 | Okamura et al. | |
| 5,512,833 | A | 4/1996 | Fukuda et al. | |
| 5,614,820 | A * | 3/1997 | Aoyama et al. | 324/754.14 |
| 6,193,549 | B1 * | 2/2001 | Suzuki et al. | 439/589 |
| 7,241,168 | B2 * | 7/2007 | Sakurai et al. | 439/511 |

FOREIGN PATENT DOCUMENTS

| | | |
|---|---|---|
| JP | A-07-113836 | 5/1995 |
| JP | A-07-254449 | 10/1995 |
| JP | A-2001-176595 | 6/2001 |
| JP | A-2007-287418 | 11/2007 |

* cited by examiner

JOINT CONNECTOR AND WIRE SHORT-CIRCUITING METHOD USING THE SAME

TECHNICAL FIELD

The present invention relates to a joint connector designed to be used, in an automobile wire harness and others, to mutually electrically short-circuit a plurality of wire-side terminals provided on respective ends of electric wires for forming a branch circuit or the like, and a wire short-circuiting method using the joint connector.

BACKGROUND ART

Heretofore, as the above type of joint connector, there has been known one disclosed in the following Patent Document 1. This connector comprises a joint terminal and a connector housing holding the joint terminal.

The joint terminal is to mutually short-circuit a plurality of wire-side terminals each provided on an end of each of a plurality of electric wires, integrally having a plurality of electric contact portions and a connection portion. The electric contact portions are arranged in a specific direction, and connected to each other through the connection portion. Each of the electric contact portions allows the wire-side terminal to make contact with the electric contact portion, the contact letting all of the wire-side terminals be mutually short-circuited through the joint terminal.

In the connector housing, there is formed a plurality of flexible support pieces. Each of the flexible support pieces extends inwardly from an inner surface of an outer wall of the connector housing to function as a terminal locking piece for locking an associated one of the wire-side terminals at a position where the associated wire-side terminal contacts one of the electric contact portions.

However, the above conventional joint connector has a problem in its inspection. Reliable mutual short-circuit of a plurality of electric wires by use of the joint connector requires an inspection of an insertion state of the wire-side terminals in the connector housing of the joint connector; however, the joint terminal of the joint connector is located at a deepmost position of an internal space of the contact housing, which makes it non-easy to determine, from outside the connector, whether each of the wire-side terminals is inserted to reach a position to be fully fitted with the joint terminal.

For the purpose of the determination, there has been performed providing a so-called "retainer" to the connector housing. This retainer is attached to the connector housing movably between a temporary locking position to permit an insertion of the wire-side terminal into the connector housing and a final locking position to secondarily lock the wire-side terminal completely inserted, not being permitted to displace from the temporary locking position to the final locking position except in a state that the wire-side terminal has been inserted into the connector housing to reach a proper position. The addition of this retainer, however, involves an increase in the number of components of the joint connector and an enlargement of the joint connector.

Patent Document 1: JP UM 4-27588

SUMMARY OF THE INVENTION

In view of the above circumstances, it is an object of the present invention to provide a joint connector capable of allowing a plurality of wire-side terminals each provided on an end of each of a plurality of electric wires to be mutually electrically short-circuited in a reliable manner, while avoiding an increase in the number of components and size thereof.

A joint connector according to the present invention comprises a joint terminal adapted to be connected collectively to the wire-side terminals to mutually short-circuit the wire-side terminals, and a connector housing formed of an insulating material to hold the joint terminal in the connector housing. The joint terminal integrally has a plurality of electric contact portions each having a shape contactable with each of the wire-side terminals, the electric contact portions being arranged in a specific direction, and a short-circuiting portion extending in an arrangement direction of the electric contact portions and be connected to each of the electric contact portions. The connector housing has a main body wall surrounding a plurality of terminal insertion spaces into which the wire-side terminals can be inserted respectively so as to contact the respective electric contact portions of the joint terminal inside the connector housing; the body wall is formed with a plurality of terminal locking pieces each having a locking portion capable of being engaged with the wire-side terminal inserted into the terminal insertion space so as to contact the electric contact portion.

In addition to the above matters, the joint connector according a first aspect of the present invention involves that: each of the terminal locking pieces has a shape deflectable so as to be retracted from the wire-side terminal perpendicularly to an insertion direction thereof and oppositely to the terminal insertion space, and a position of the terminal locking piece is set such that, until the wire-side terminal reaches a proper insertion depth position in the terminal insertion space, the terminal locking piece is deflected, by a pressing force from the wire-side terminal, so as to project outwardly from the main body wall, and, when the wire-side terminal reaches the proper insertion depth position, the wire-side terminal is electrically connected to the joint terminal and the terminal locking piece comes back into the main body wall by its elastic returning force.

On the other hand, the joint connector according to a second aspect of the present invention involves that the connector housing is further formed to have a jig insertion space permitting the deflection of each of the terminal locking pieces and an insertion of a jig for detecting the deflection into the jig insertion space.

The present invention further provides a method of mutually electrically short-circuiting a plurality of electric wires each having a wire-side terminal provided on an end thereof, by use of the joint connector according to the first or second aspect of the present invention. The method comprises a short-circuiting step of inserting the wire-side terminals into the terminal insertion spaces defined in the connector housing of the joint connector respectively and bringing the wire-side terminals into contact with corresponding ones of the electric contact portions to mutually short-circuit the wires, and an inspection step of detecting a projection state of the terminal locking pieces from the main body wall of the connector housing following completed insertion of each of the wire-side terminals, and determining an adequacy of the insertion of the wire-side terminal corresponding to each of the terminal locking pieces based on a result of the detection.

In the present invention, the use of the deflection of each of the terminal locking pieces formed in the connector housing of the joint connector enables an insertion state of each of the wire-side terminals in the connector housing of the joint connector to be easily and accurately determined, without an increase in the number of components and in size of the joint connector. This ensures the short-circuiting across the wires by use of the joint connector.

DESCRIPTION OF THE PREFERRED EMBODIMENTS

Figure 1:
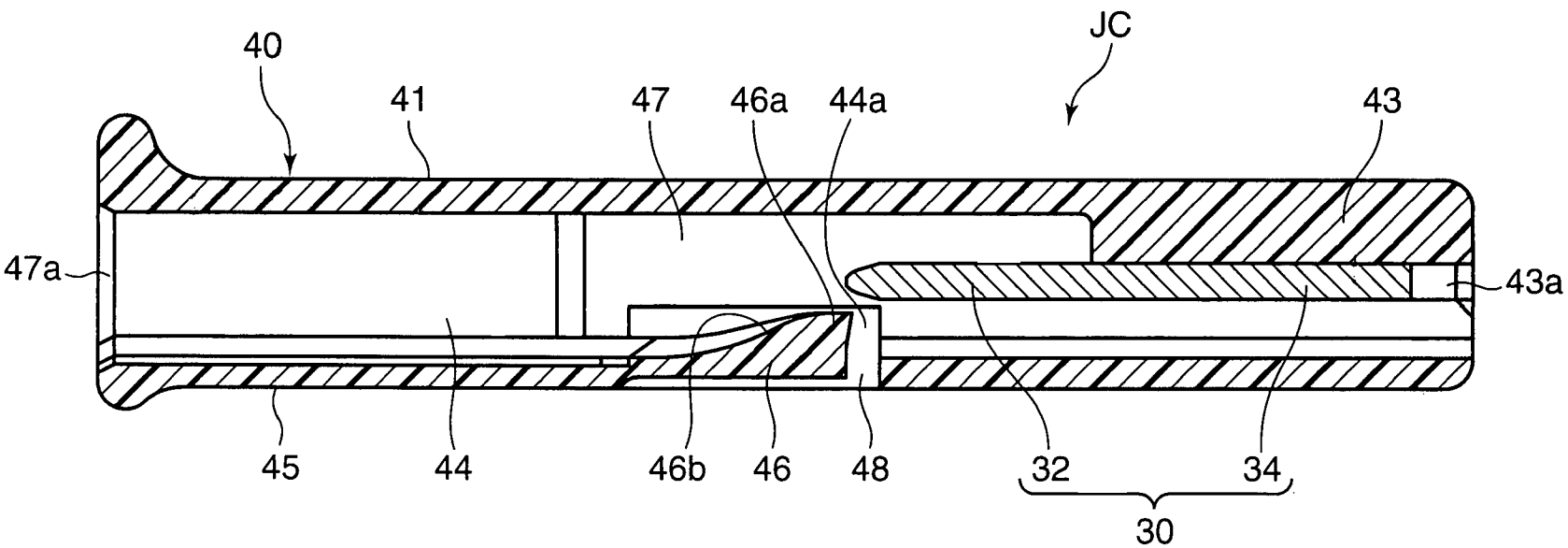
FIG. 1 is a sectional front view of a joint connector according to a first embodiment of the present invention.

With reference to the drawings, the present invention will be described based on a preferred embodiment thereof.

FIGS. 1 to 5 show a joint connector JC according to a first embodiment of the present invention. The joint connector JC is designed to mutually short-circuit a plurality of wire-side terminals 20 each provided on an end of each of a plurality of (in the first embodiment, four) electric wires 10 illustrated in FIGS. 6 to 8.

Each of the wires 10 comprises a conductor and an insulating sheath covering the conductor, having an end in which the insulating sheath is removed to expose the conductor, onto which the wire-side terminal 20 is crimped.

The wire-side terminal 20 in the first embodiment, which is formed by bending a single metal plate, has a female-type electric contact section 22 and a wire-crimping section 24, which are axially arranged on respective front and rear sides.

The electric contact section 22 has a hollow angular tube-shaped main body and a contact spring piece 26 provided within the main body while allowed to be deflected, an engagement piece 28 protruding obliquely rearwardly from a lower surface of the body. The engagement piece 28 serves as an engagement portion to be locked at a side of an after-mentioned connector housing 40 of the joint connector JC.

Figure 6:
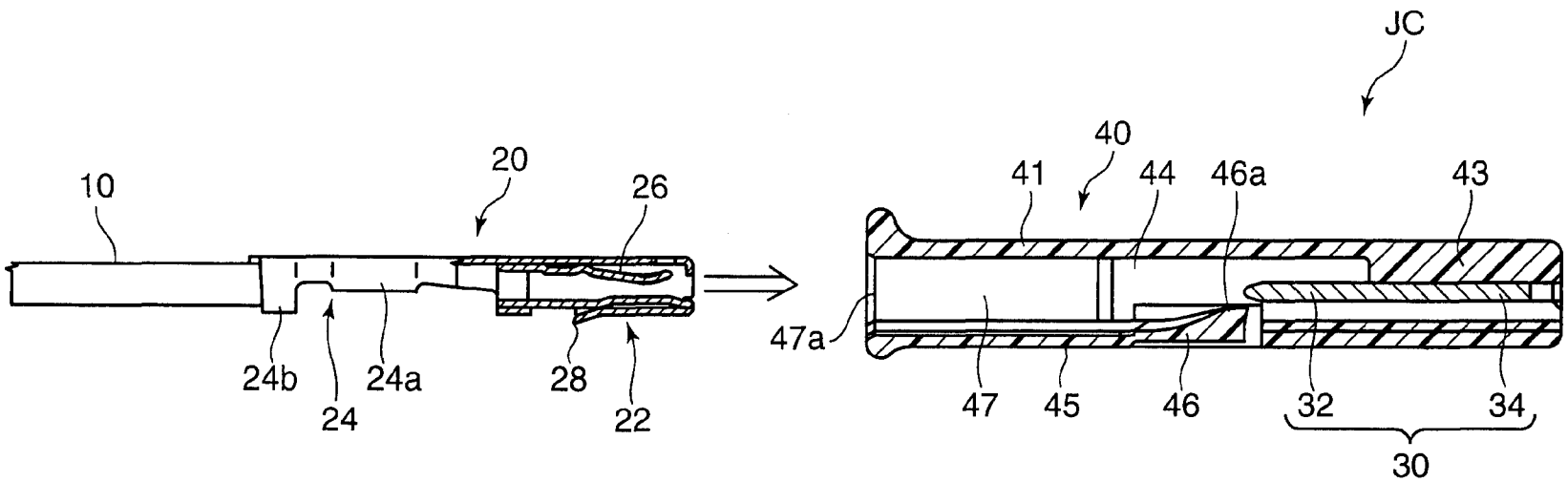
FIG. 6 is a sectional front view showing a state before a wire-side terminal is inserted into the joint connector.

The wire-crimping section 24 has conductor barrels 24*a* and insulation barrels 24*b* on respective ones of front and rear sides thereof, as shown in FIG. 6. The conductor barrels 24*a*, which are formed on opposite sides in a widthwise direction of the terminal, are crimped onto the conductor so as to enfold the end of the conductor of the wire 10, thus electrically connected to the conductor. The insulation barrels 24*b*, which are also formed on opposite sides in the widthwise direction of the terminal, are crimped onto the wire 10 so as to enfold the insulating sheath of the wire 10 at a position rearward of the conductor barrels 24*a*.

Figure 2:
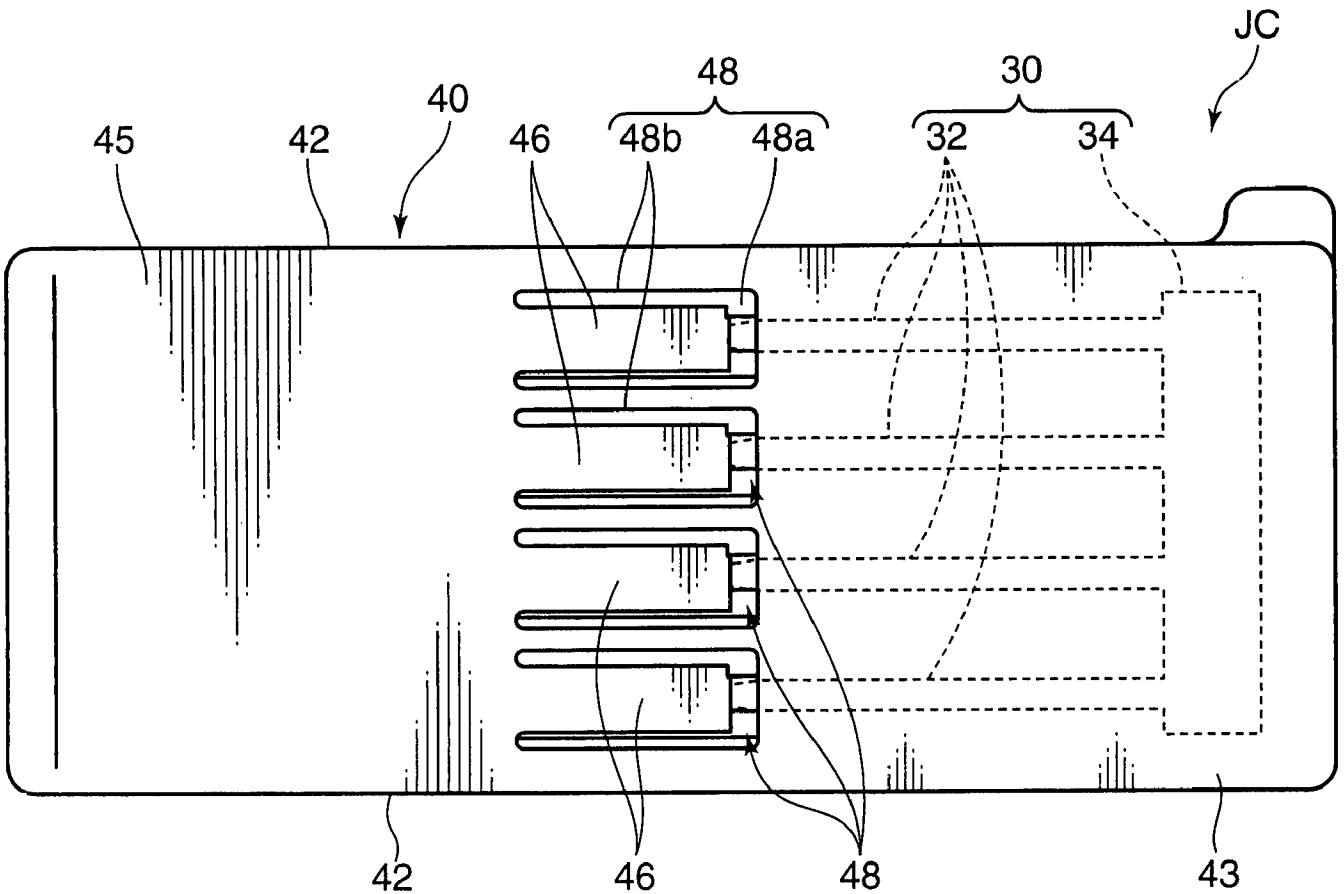
FIG. 2 is a bottom view of the joint connector.
Figure 3:
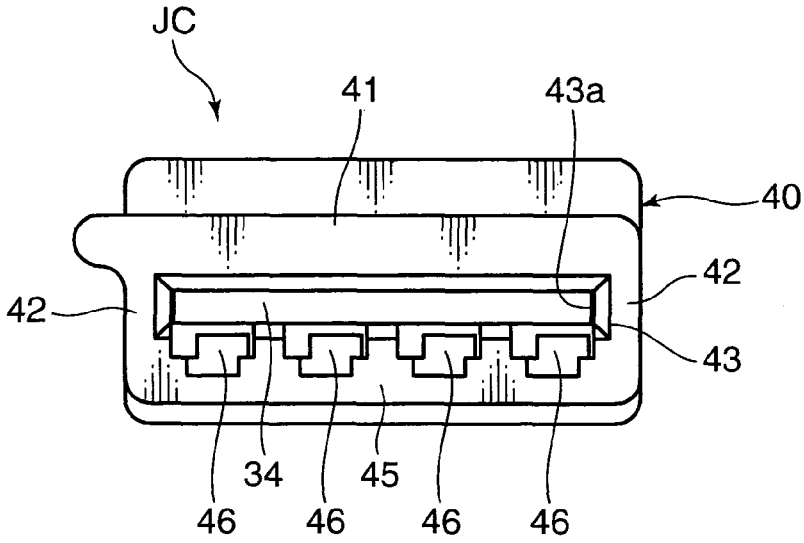
FIG. 3 is a side view of the joint connector, when viewed from the side of a joint terminal thereof.
Figure 4:
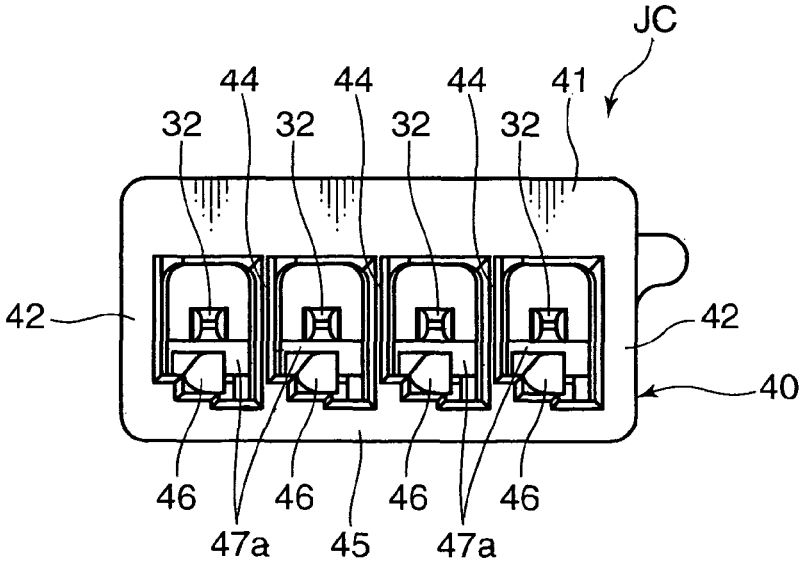
FIG. 4 is a side view of the joint connector, when viewed from the side of a wire-side terminal insertion section.

The joint connector JC comprises a joint terminal 30 shown in FIGS. 1 and 2 and a connector housing 40 holding the joint terminal 30. The joint terminal 30, which is made of an electrically conductive material, is adapted to be collectively and electrically connected to a plurality of the wire-side terminals 20, to mutually shout-circuit the wire-side terminals 20. The connector housing 40 is entirely formed of an insulating material, such as a synthetic resin, as a single piece, having a shape capable of holding the joint terminal therein.

The joint terminal 30 in the first embodiment is composed of a single metal plate. Specifically, the joint terminal 30 integrally has a plurality of electric contact portions 32, and a short-circuiting portion 34 adapted to collectively short-circuit the electric contact portions 32. Each of the electric contact portions 32 is a male-type tab fittable into the female-type electric contact section 22 of the wire-side terminal 20; the electric contact portions 32 are arranged in a direction perpendicular to an axial direction thereof. The short-circuiting portion 34 extends in an arrangement direction of the electric contact portions 32 and is continued to respective base ends of the electric contact portions 32.

The connector housing 40 is integrally formed of an insulating material so as to have an approximately rectangular parallelepiped profile. Specifically, the connector housing 40 integrally has a flat plate-shaped top wall 41, right and left sidewalls 42 extending downwardly from respective ones of widthwisely opposite ends of the top wall 41, a bottom wall 45 connecting respective lower ends of the sidewalls 42 to each other, a terminal-holding portion 43 continued to respective rear ends (in FIG. 1, right ends) of the walls 41, 42 and 45, a plurality of terminal-insertion partition walls 44, and a plurality of lances (terminal locking pieces) 46 formed in the bottom wall 45.

The terminal-holding portion 43 has a shape capable of holding the short-circuiting portion 34 of the joint terminal 30. Specifically, the terminal-holding portion 43 has an outer shape larger than that of the short-circuiting portion 34, surrounding a joint-terminal insertion port 43*a* through which the short-circuiting portion 34 can be inserted from a front side (in FIG. 1, right side). The short-circuiting portion 34 is press-fitted into the terminal-holding portion 43 through the insertion hole 43*a* while directing the electric contact portions 32 in a rearward direction (in FIG. 1, leftward direction). More specifically, the short-circuiting portion 34 is formed with two protrusions (not shown) on widthwisely opposite ends thereof, and each of the protrusions bites into an inner surface of the terminal-holding portion 43 to fix the short-circuiting portion 34 within the joint-terminal insertion port 43*a*.

The terminal-insertion partition walls 44 are spaced to each other in the same direction as the arrangement direction of the electric contact portions 32. A pair of the partition walls 44 adjacent to each other define, therebetween, a terminal insertion space 47 into which the wire-side terminal 20 can be inserted to be connected to a corresponding one of the electric contact portions 32. The terminal insertion spaces 47 are opened rearward of the connector housing 40 (oppositely to the terminal-holding portion 43) to form respective terminal insertion ports 47*a*, through which the wire-side terminals 20 are inserted in the terminal insertion spaces 47 respectively.

The bottom wall 45 constitutes, in cooperation with the top wall 41 and the two sidewalls 42, a main body wall surrounding the terminal insertion spaces 47 from four directions. Specifically, the bottom wall 45 is continued to the sidewalls 42 and the partition walls 44 so as to cover the terminal insertion spaces 47 from an opposite side of the top wall 41.

The lances 46 are provided individually to the terminal insertion spaces 47. Specifically, there are formed a plurality of slits 48 in the sub wall 45, each of the slits 48 separating the lance 46 from a main section of the bottom wall 45. Each of the slits 48 has a region 48*a* extending in the width direction just below a corresponding one of the electric contact portions 34, and two regions 48*b* extending rearward from opposite ends of the region 48*a*. Accordingly, the lance 46 bounded by the slit 48 is of a cantilever shape having a base end integrally continued to the main section of the bottom wall 45 and a front end capable of being deflected in a thickness direction of the bottom wall 45 (an upward-rearward direction in FIG. 1) while the base end is supported.

Figure 7:
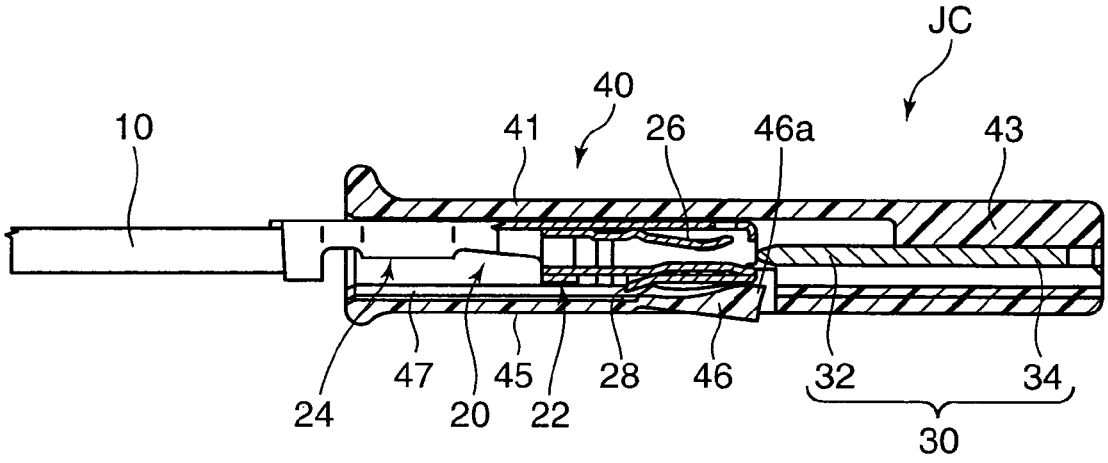
FIG. 7 is a sectional front view showing a state when the wire-side terminal is being inserted into the joint connector.
Figure 8:
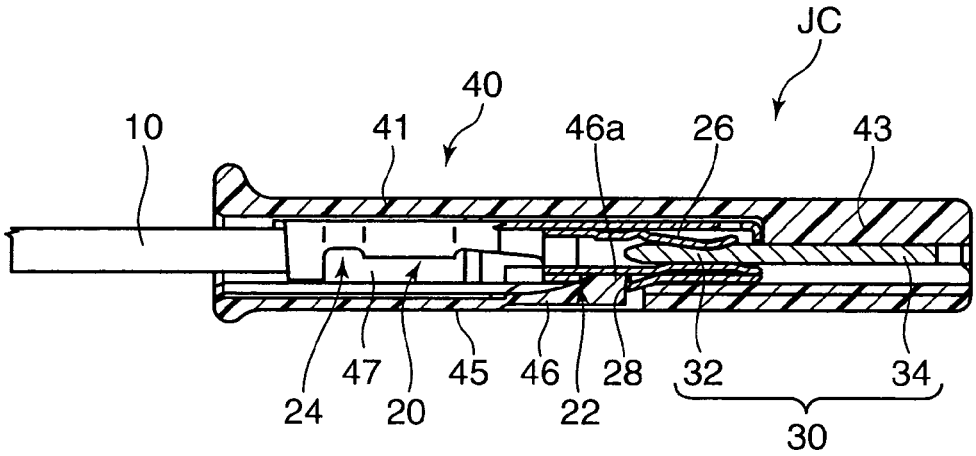
FIG. 8 is a sectional front view showing a state after completion of the insertion of the wire-side terminal into the joint connector.

The front end, which is a free end of the lance 46, has an end surface, which serves as a locking portion 46*a* for locking the engagement piece 28 of the wire-side terminal 20. The locking portion 46*a*, as shown in FIGS. 7 and 8, locks the wire-side terminal 20 inserted into the terminal insertion space 47 and fitted onto the electric contact portions 32. Specifically, the locking portion 46*a* touches the engagement piece 28 of the wire-side terminal 20 at the rear side of the connector housing 40 (left side in FIG. 8) to prevent the wire-side terminal 20 from being pulled out of the connector housing 40.

Figure 5:
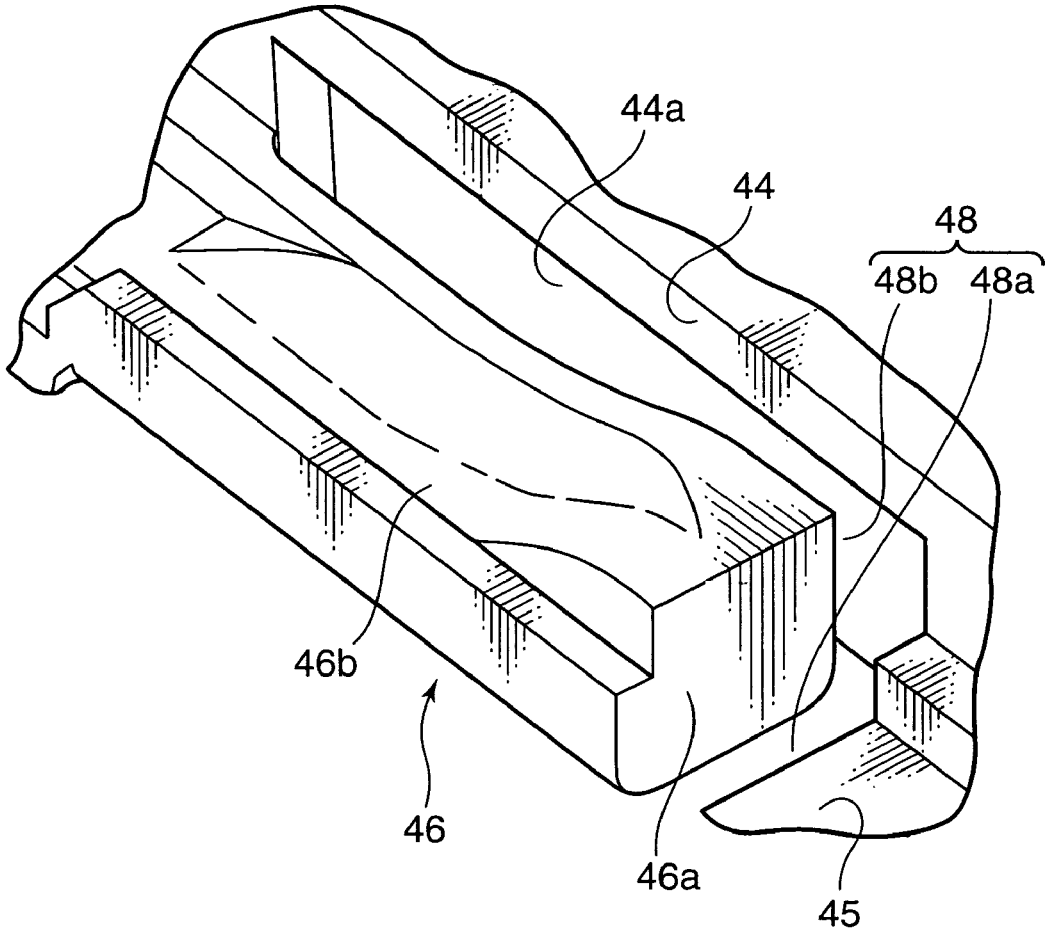
FIG. 5 is a perspective view of a lance included in the joint connector.

As shown in FIG. 5, each of the lances 46 has an upper surface, in which a guide groove 46*b* is formed to make smooth sliding contact with the engagement piece 28 of the wire-side terminal 20. Furthermore, the lance 46 is so positioned as to act as follows.

At first, the lance 46, when the wire-side terminal 20 is inserted into the terminal insertion space 47 as shown in FIG. 7, contacts the engagement piece 28 of the wire-side terminal 20 at the guide groove 46, and receives a pressing force from the engagement piece 28 to be deflected downwardly (i.e., in a direction away from the terminal insertion space 47). The deflection of the lance 46 begins at a timing before the contact of the front end of the wire-side terminal 20 with the front end of a corresponding one of the electric contact portions 32 as shown in FIG. 7, displacing the front end of the lance 46 from a position above (inside) the lower surface of the bottom wall 45, to a position where the lance 46 projects downwardly (outwardly) beyond the lower surface of the bottom wall 45.

When the wire-side terminal 20 reaches a proper insertion depth position where it is fully fitted onto the electric contact portion 32 and electrically connected to the joint terminal 30 as shown in FIG. 8, the engagement piece 28 of the wire-side terminal 20 have passed through the lance 46 to permit the lance 46 to come back to its original position, i.e., the position in the bottom wall 45, by an elastic returning force of the lance 46. The elastically returned lance 46 allows its locking portion 46*a* to be located on a rear side of the engagement piece 28 and be engaged with the engagement piece 28. This engagement adequately maintains the fitting state of the wire-side terminals 20 and corresponding ones of the electric contact portions 32, thus adequately maintaining a mutual short-circuit across the wire-side terminals 20 through the joint terminal 30.

In this embodiment, in order to reliably avoid an interference between the lance 46 and the partition wall 44 adjacent to the lance 46, each of the partition walls 44 is formed with a recess 44*a* having a shape conforming to that of the lance 46 (FIG. 5).

Next will be described a method of mutually short-circuiting four electric wires using the above joint connector JC.

1. Short-Circuiting Step

In the short-circuiting step, the wire-side terminal 20 provided on the end of the wire 10, as shown in FIG. 6, is inserted into an appropriate one of the terminal insertion spaces 47 of the connector housing 40, as shown in FIG. 7, and reaches to the proper insertion depth position illustrated in FIG. 8, thereby fitting onto (contacting) the electric contact portion 32 of the joint terminal 30 to be electrically connected thereto. During this process, the deflection of the lance 46 of the connector housing 40 begins (preferably, the deflection is large enough to be detected by an after-mentioned terminal-insertion detecting jig 56 or the like) before the front end of the wire-side terminal 20 contacts the front end of the electric contact portion 32 as shown in FIG. 7, and thereafter is elastically returned to the original position when the wire-side terminal 20 reaches the proper insertion depth position illustrated in FIG. 8. At this elastically returned position, the locking portion 46*a* of the lance 46 locks the engagement piece 28 of the wire-side terminal 20 from the side of the rear end of the connector housing 40.

Thus, all of the wire-side terminals 20 fit to corresponding ones of the electric contact portions 32, thereby making the wire-side terminals 20 be mutually shout-circuited through the joint terminal 30. Moreover, this short-circuit state is maintained by the lances 46 whose locking portions 46*a* lock the wire-side terminals 20.

Inspection Step

In the inspection step, there is performed a determination on whether each of the wire-side terminals 20 reaches the proper insertion depth position illustrated in FIG. 8. This determination can be readily performed by checking a state of projection of each of the lances 46 from the bottom wall 45. Specifically, the projection state of the lances 46 enables the insertion position of the wire-side terminals 20 to be determined for the following reason: each of the lances 46 receives a pressing force from the engagement piece 28 of the wire-side terminal 20 to be deflected so as to project outwardly from an outer surface (lower surface) of the bottom wall 45 until the wire-side terminal 20 reaches the proper insertion depth position; on contrast, when the wire-side terminal 20 reaches the proper insertion depth position, the lance 46 comes back to a position inward (upward) of the outer surface of the bottom wall 45 by the elastic returning force thereof.

Particularly, in the first embodiment, since the position of the lance 46 is set to let the deflection of the lance 46 begin before the timing of the contact of the wire-side terminal 20 with the front end of the corresponding electric contact portion 32 as shown in FIG. 7, checking an electrical conduction between the wire-side terminal 20 and the joint terminal 30 having the corresponding electric contact portion 32 enables it to be determined whether the lance 46 positioned inside the outer surface of the bottom wall 45 teaches that the wire-side terminal 20 has not been inserted yet or that the insertion has been completed.

Specifically, according to the joint connector JC according to the first embodiment, the combination of the detection result on the projection of the lance 46 and that on electrical conduction between the wire-side terminal and the joint terminal 30 allows the following determination to be performed.

a. When the lance 46 projects from the bottom wall 45→the wire-side terminal 20 be semi-inserted (inadequate insertion).

b. If the lance 36 does not project from the bottom wall 45 and the terminals 20 and 30 has no electrical conduction therebetween→the wire-side terminal 20 not be inserted or be semi-inserted (inadequate insertion).

c. If the lance 36 does not project from the bottom wall 45 and the terminals 20 and 30 has an electrical conduction therebetween→the wire-side terminal 20 be fully inserted (adequate insertion).

Furthermore, the bottom wall 45 of the connector housing 40 according to the first embodiment, being exposed outside the joint connector JC, permits the projection state of the lance 46 to be visually checked in an easy manner. Alternatively, the insertion state of each of the wire-side terminals may be inspected using a dedicated inspection device 50 as shown in FIGS. 9 to 11.

The inspection device 50 comprises a casing 52, a connector-insertion detecting jig 54 and a plurality of terminal-insertion detecting jigs 56 corresponding to respective ones of the wire-side terminals 20.

Figure 9:
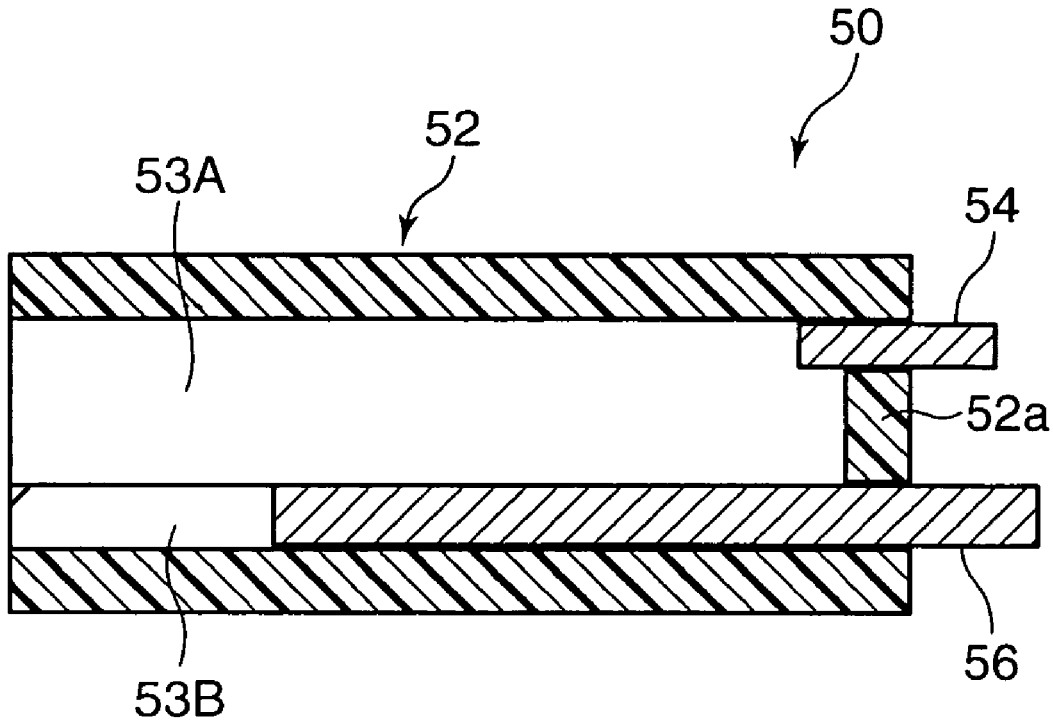
FIG. 9 is a sectional front view showing one example of an inspection device for inspecting the insertion of the wire-side terminal in the joint connector.
Figure 10:
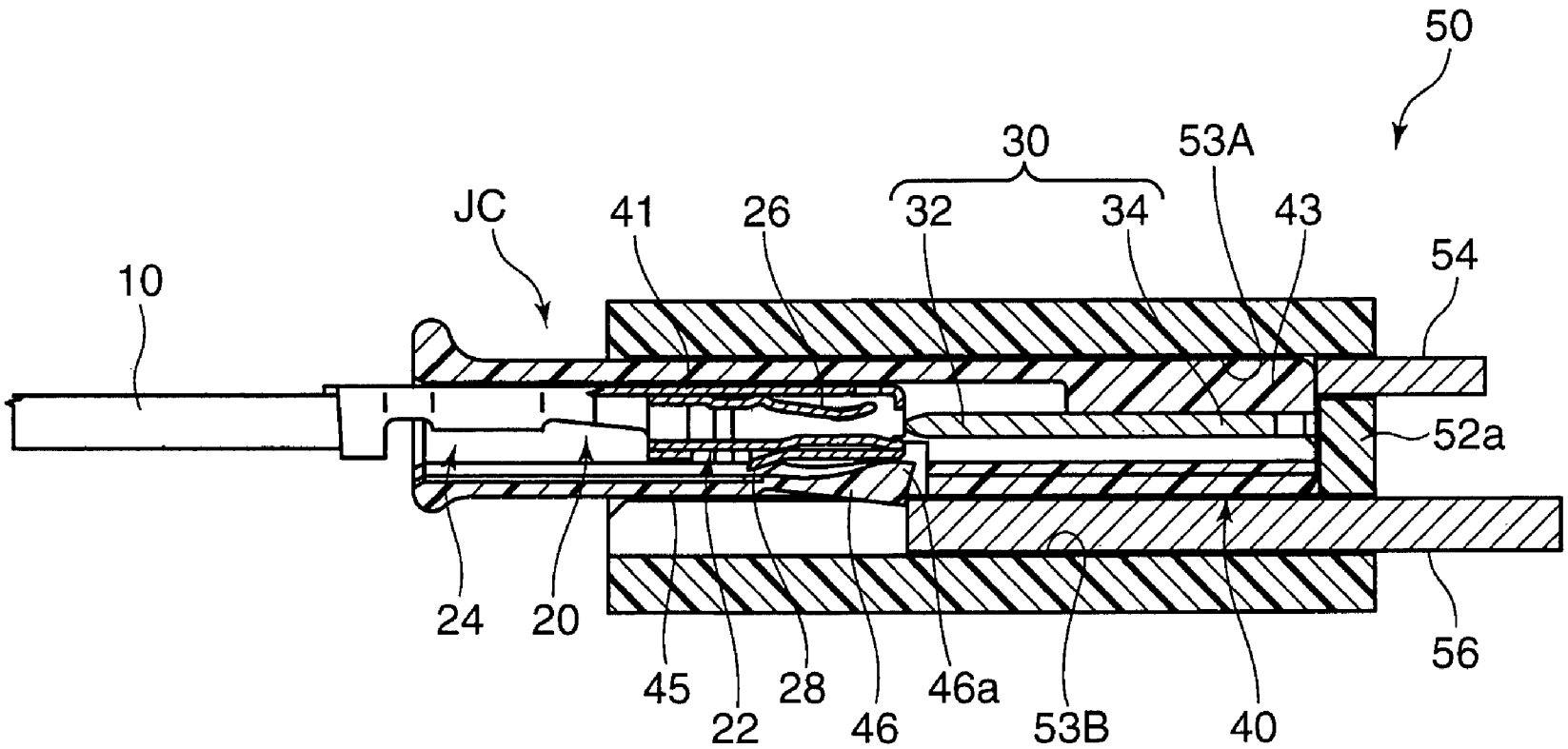
FIG. 10 is a sectional front view showing a state after a joint connector having a wire-side terminal improperly inserted therein is inserted into a casing of the inspection device.
Figure 11:
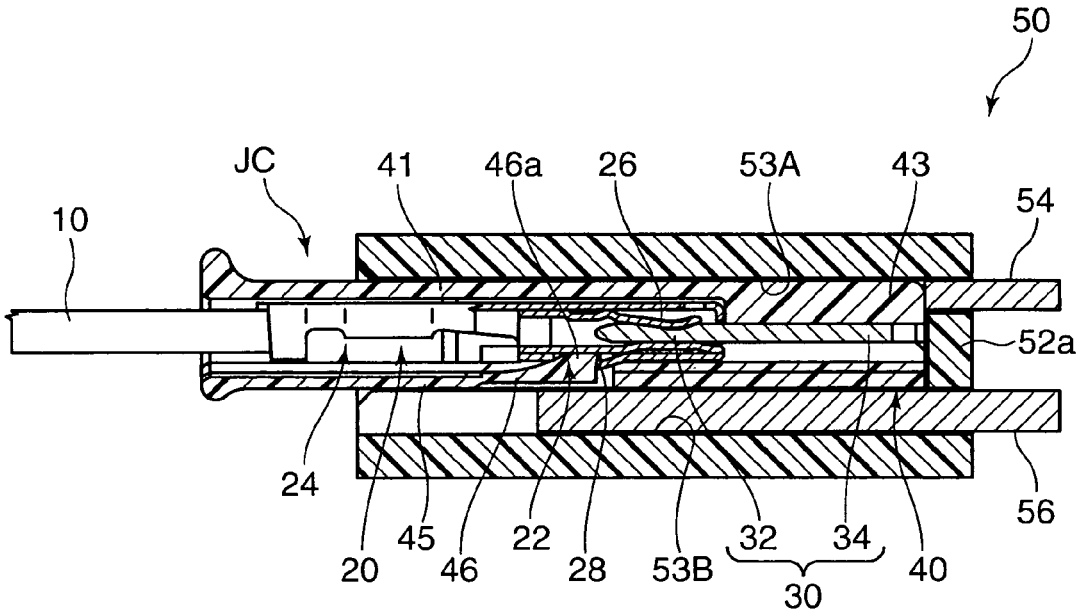
FIG. 11 is a sectional front view showing a state after a joint connector having a wire-side terminal properly inserted therein is inserted into the casing of the inspection device.
Figure 12:
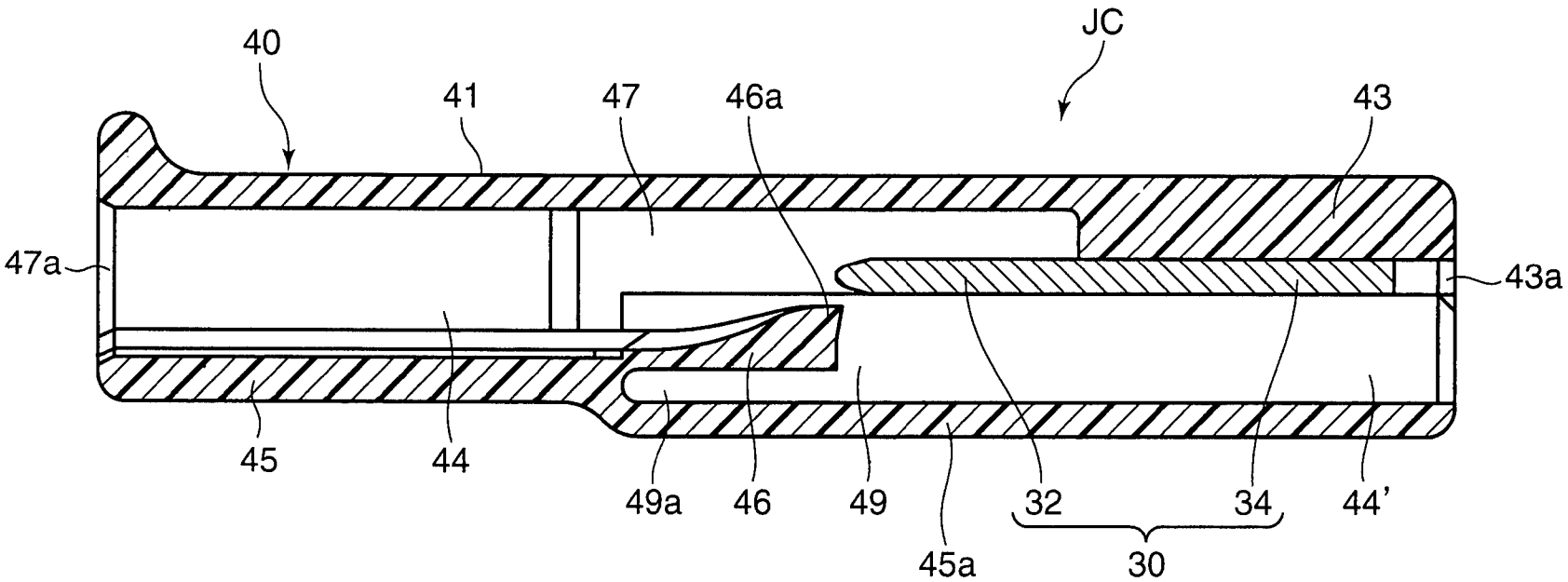
FIG. 12 is a sectional front view of a joint connector according to a second embodiment of the present invention.
Figure 13:
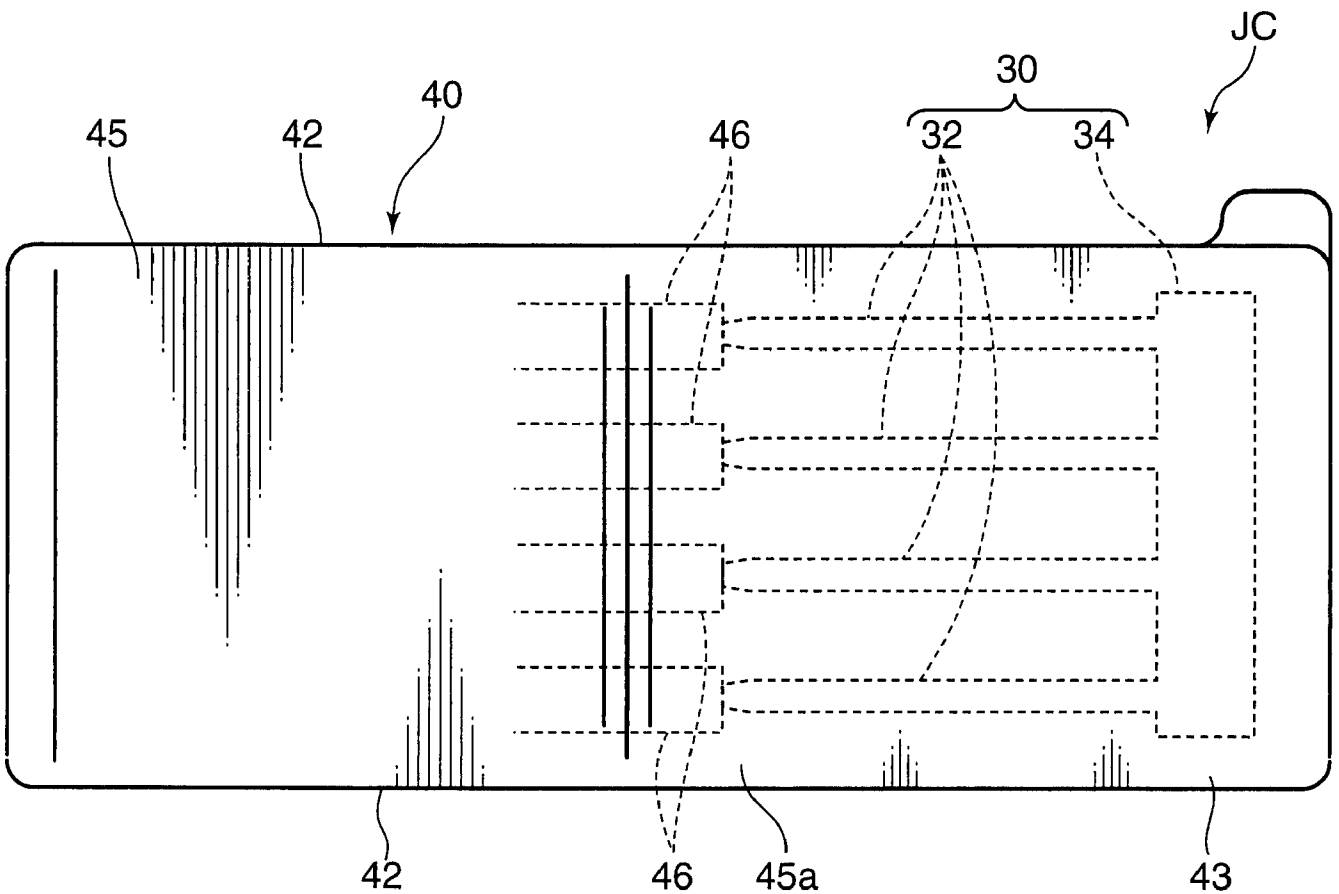
FIG. 13 is a bottom view of the joint connector illustrated in FIG. 12.
Figure 14:
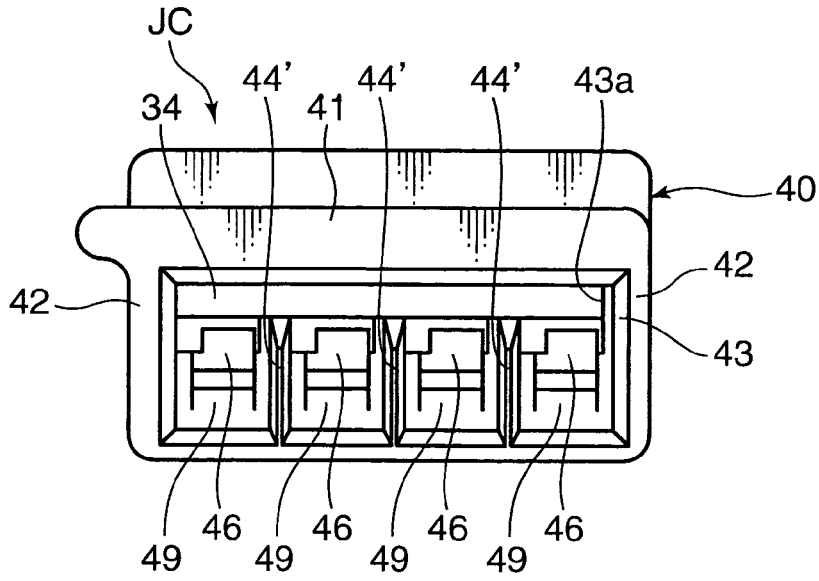
FIG. 14 is a side view of the joint connector illustrated in FIG. 12, when viewed from the side of a joint terminal thereof.
Figure 15:
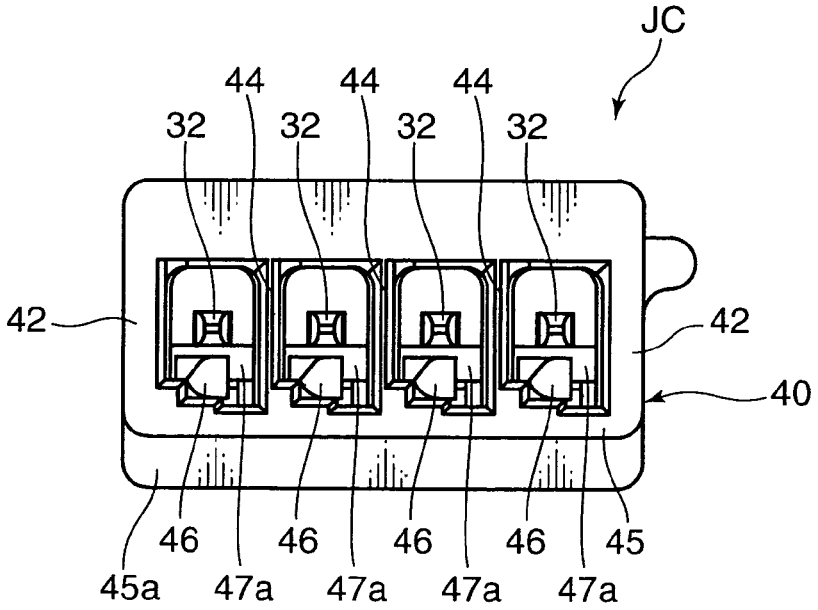
FIG. 15 is a side view of the joint connector illustrated in FIG. 12, when viewed from the side of a wire-side terminal insertion section.

The casing 52, which has a container-like shape opened in one direction, has a back wall 52*a* on a side opposite to the opening (in FIGS. 9 to 11, left side). The casing 52 defines a connector insertion space 53A for permitting the insertion of the joint connector JC into the casing 52 and a plurality of jig insertion spaces 53B for permitting the insertions of the terminal-insertion detecting jigs 56 thereinto respectively just below the connector insertion space 53A.

As shown in FIG. 9, the connector-insertion detecting jig 54 is so positioned as to penetrate through an upper region of the back wall 52*a* and protrude beyond the back wall 52*a* into the connector insertion space 53A by a given distance. Similarly, each of the terminal-insertion detecting jigs 56 is so positioned as to penetrate a lower region of the back wall 52*a* and be inserted into the corresponding jig insertion space 53B by an appropriate depth. Each of the jigs 54 and 56 may be given a biasing force inwardly of the casing 52 (left in FIGS. 9 to 11) by a spring mechanism or the like.

In the above inspection device 50, the joint connector JC (specifically, the joint connector JC into which the wire-side terminals 20 has already been inserted) is inserted into the connector insertion space 53A through the opening of the casing 52. During this process, a displacement of the connector-insertion detecting jig 54*a* teaches that the joint connector JC is inserted enough to reach a proper position inside the casing 52. Specifically, the joint connector JC inserted into the casing 52 up to a position shown in FIG. 10 or 11 let the front end of the connector housing 40 of the joint connector JC push the connector-insertion detecting jig 54 outwardly of the casing 52: that is why the displacement of the jig 54 teaches the insertion position of the joint connector JC.

Hereupon, the insertion position of each of the terminal-insertion detecting jigs 56 is set to a position where jig 56 locates its tip rearward of the front end of each of the lances 46 in the joint connector JC. This enables an adequacy of the insertion of each of the wire-side terminals 20 in the joint connection JC to be easily determined based on the presence or absence of the displacement of the terminal-insertion detecting jig 56.

Specifically, when a specific one of the wire-side terminals 20 in the joint connector JC is incompletely inserted, i.e., when the front end of the lance 46 corresponding to the specific wire-side terminal 20 projects downwardly beyond the lower surface of the bottom wall 45, the front end of the lance 46 pushes a corresponding one of the terminal-insertion detecting jigs 56 outwardly of the casing 52 to retract the terminal-insertion detecting jig 56 from its original position. On contract, when the insertion of the wire-side terminal 20 in the joint connector JC is complete, i.e., the lance 46 corresponding to the wire-side terminal 20 is positioned within the lower surface of the bottom wall 45, no contact is made between the lance 46 and the corresponding terminal-insertion detecting jig 56, thereby the jig 56 not being displaced. Accordingly, the presence or absence of the displacement of each of the jigs 56 enables the insertion state of the wire-side terminal 20 corresponding to the jug 56 to be determined.

Next will be described a second embodiment of the present invention below with reference to FIGS. 12 to 21. As for this second embodiment, a common element or component with that in the first embodiment is defined by the same reference code, and its description will be omitted; mainly described will be only difference points therebetween.

In the second embodiment, a part of the bottom wall 45 in the first embodiment, which part is at a front side of the lance 46, constitutes a cover wall 45*a*. This cover wall 46 is located outwardly (downwardly in the posture in FIG. 12) of each of the lances 46, covering the lances 46 from outside.

Inside the cover wall 45*a*, there is kept a jig insertion space 49. Furthermore, the jig insertion space 49 is partitioned, in one-to-one relation with the lances 46, by a plurality of partition walls 44' continued to respective ones of the terminal-insertion partition walls 44. Each of the partitioned jig insertion spaces 49 includes a gap 49*a* between the lance 46 and the cover wall 45*a*. The gap has a size enough to permit the deflection of the lance 46.

Also by use of this joint connector JC according to the second embodiment, mutual short-circuit of a plurality of wires 10 can be made by a method comprising a short-circuiting step and an inspection step, similarly to the first embodiment.

Figure 16:
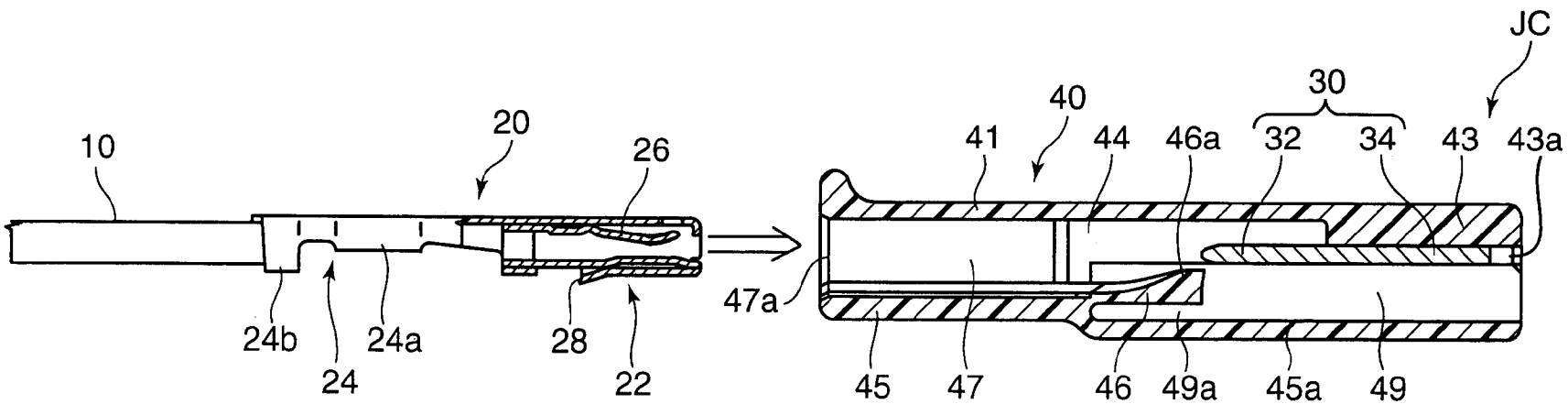
FIG. 16 is a sectional front view showing a state before a wire-side terminal is inserted into the joint connector illustrated in FIG. 12.
Figure 17:
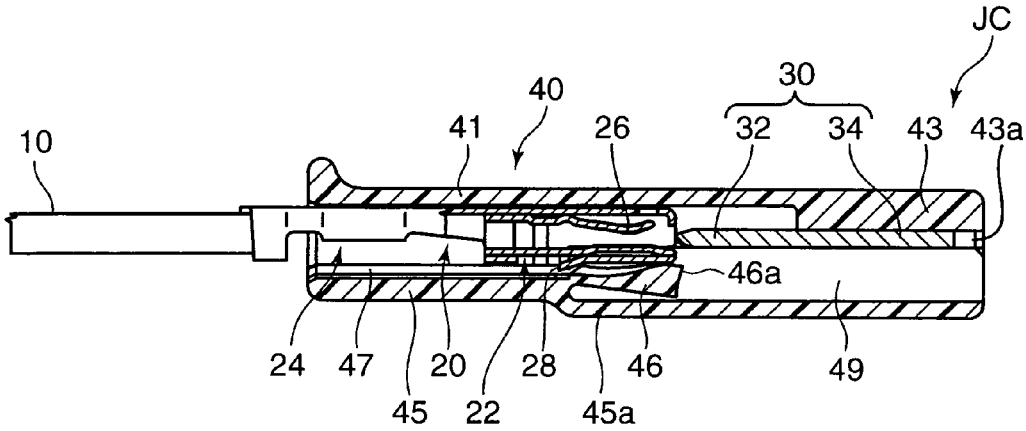
FIG. 17 is a sectional front view showing a state when the wire-side terminal is being inserted into the joint connector illustrated in FIG. 12.
Figure 18:
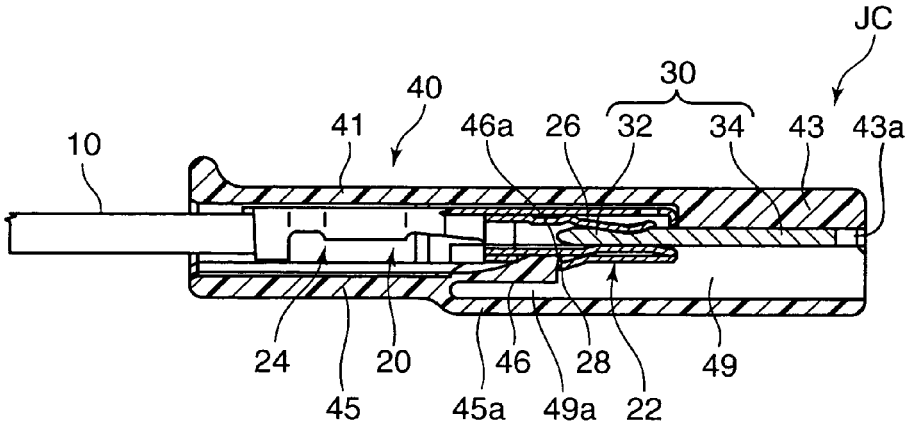
FIG. 18 is a sectional front view showing a state after completion of the insertion of the wire-side terminal into the joint connector illustrated in FIG. 12.

Hereupon, the short-circuiting step is same as that in the first embodiment. Specifically, as shown in FIGS. 16 to 18, each of a plurality of wire-side terminals 20 is inserted into a corresponding one of a plurality of terminal insertion spaces 47 to be fitted onto respective electric contact portions 32, thus establishing a short-circuit across the wires 10, while the lance 46 receives a pressing force from an engagement piece 28 of the wire-side terminal 20 to be deflected downwardly (away from the terminal insertion space 47).

The inspection step is also basically the same as that in the first embodiment in respect of including a determination of an insertion depth of each of the wire-side terminals 20 by detecting the deflection of the corresponding lance 46. However, the cover wall 45*a*, covering the lances 46 from the side of an outer surface, makes it difficult to check the deflections of the lances 46 visually and directly from outside the joint connector JC. For this reason, the jig insertion spaces 49 defined inside the cover wall 45*a* is utilized to detect the deflection.

Figure 19:
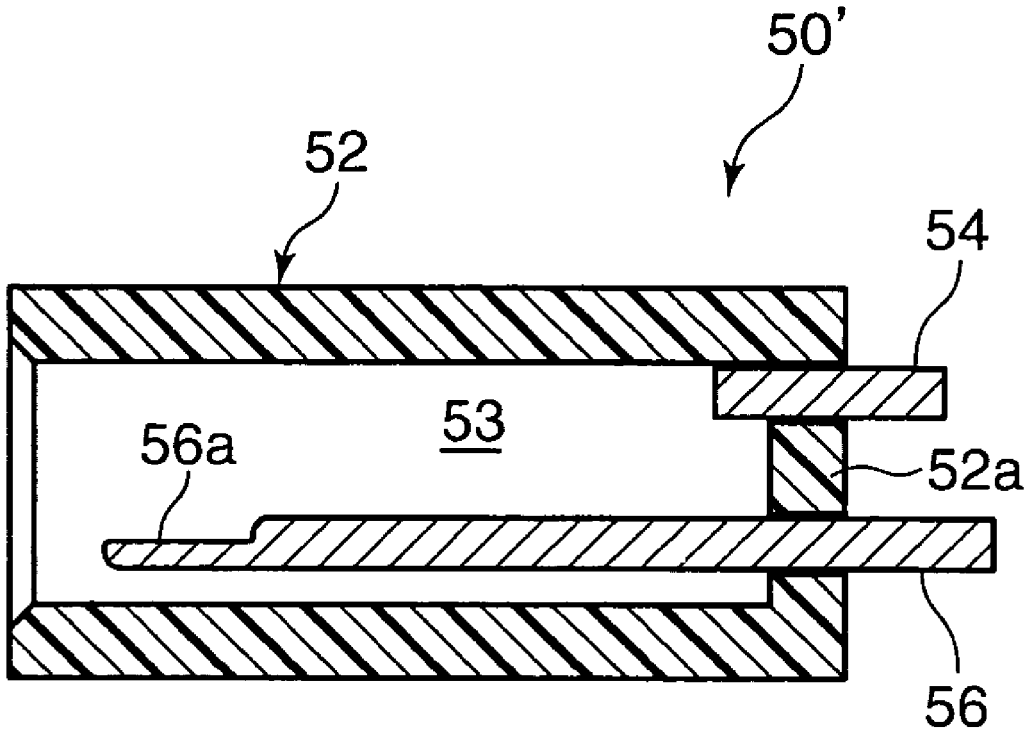
FIG. 19 is a sectional front view showing one example of an inspection device for inspecting the insertion of the wire-side terminal in the joint connector illustrated in FIG. 12.
Figure 20:
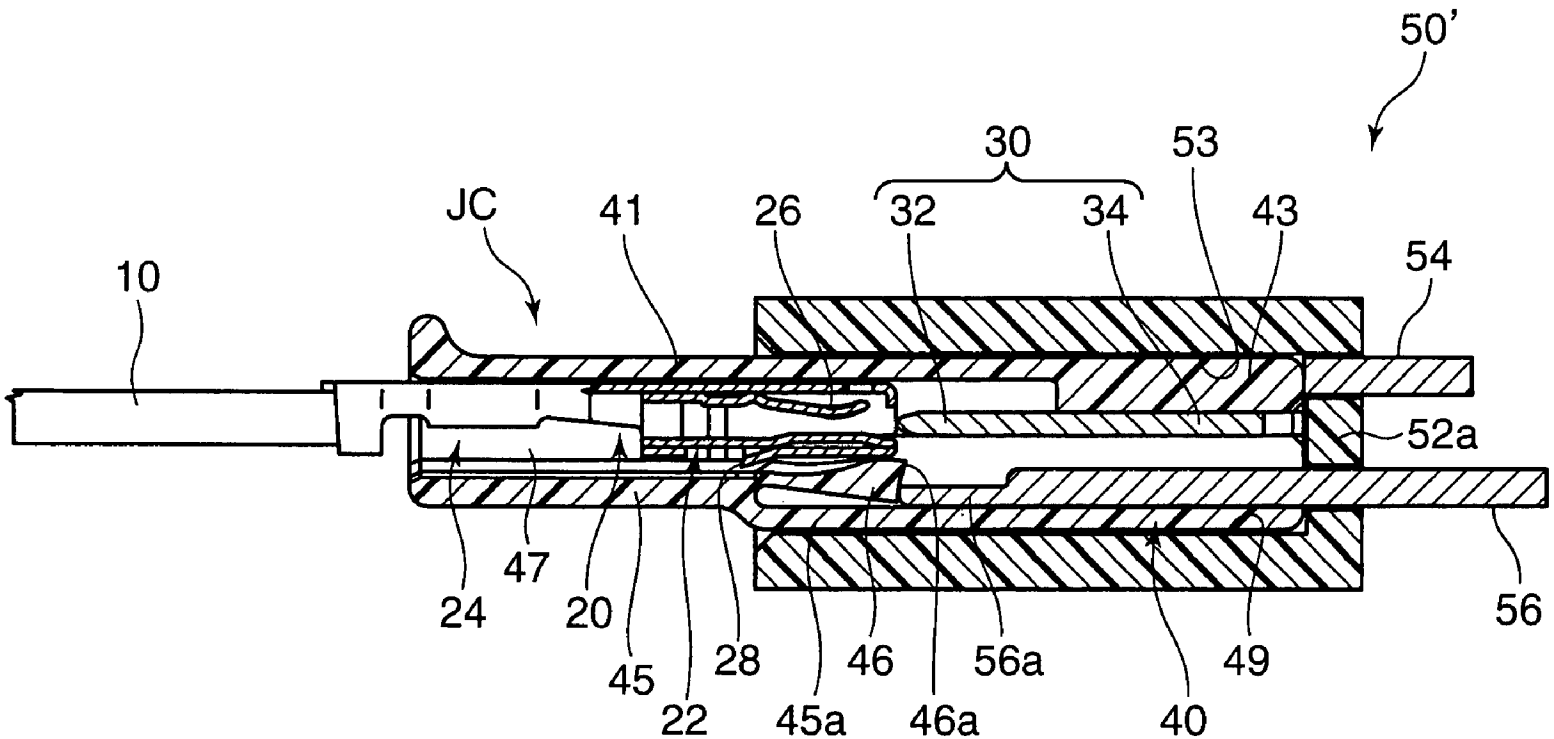
FIG. 20 is a sectional front view showing a state after a joint connector having a wire-side terminal improperly inserted therein is inserted into a casing of the inspection device illustrated in FIG. 19.
Figure 21:
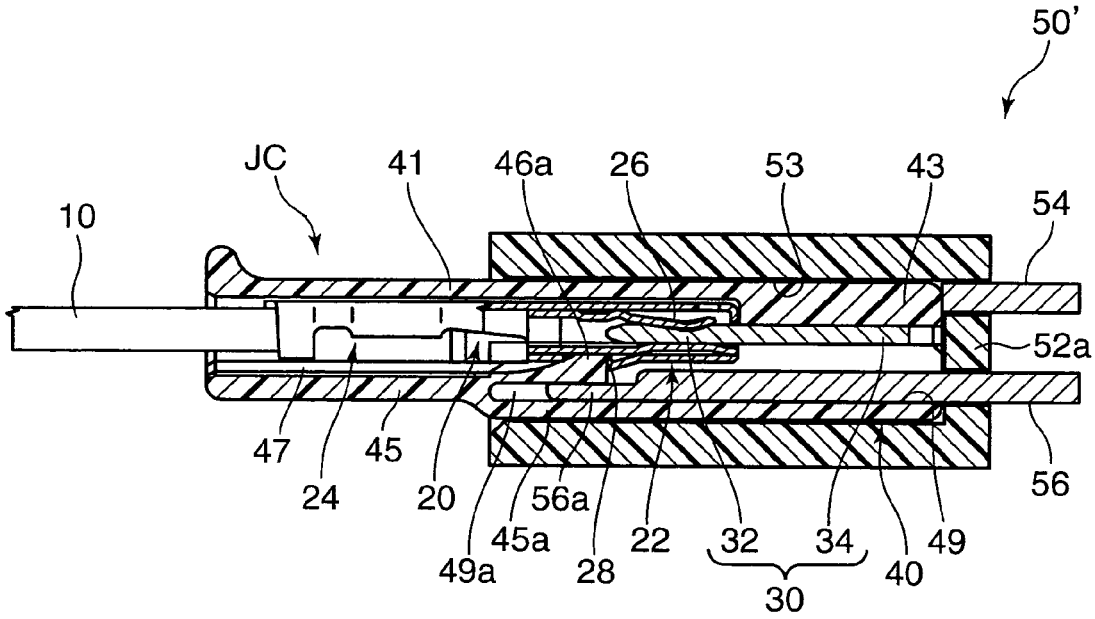
FIG. 21 is a sectional front view showing a state after a joint connector having a wire-side terminal properly inserted therein is inserted into the casing of the inspection device illustrated in FIG. 19.

FIGS. 19 to 21 show one example of an inspection device suitable for this inspection. Here is shown an inspection device 50', which comprises a casing 52, a connector-insertion detecting jig 54, and a plurality of terminal-insertion detecting jigs 56 each corresponding to each of the wire-side terminals 20, as with the inspection device 50 shown in FIGS. 9 to 11, while being different from the inspection device 50 in the following points.

Firstly, an internal space of the casing 52 is used as a connector insertion space 53 over the entire region thereof in the upward-downward direction. This means that a connector housing 40 of the joint connector JC is inserted into the casing 52 with little gap.

Secondly, each of the terminal-insertion detecting jigs 56 has a shape insertable into each of the jig insertion spaces 49 defined in the connector housing 40, held at a height position where the insertion is permitted. Furthermore, the terminal-insertion detecting jig 56 has a tip 56*a* thinner than the other part, having such a thickness that the jig 56 cannot enter between the lance 46 and the cover wall 45*a* except the lance 46 is not deflected.

Also in the inspection device 50', the joint connector JC to be inspected is inserted into a connector insertion space 53A through an opening of the casing 52, and the insertion of the joint connector JC up to a proper position inside the casing 52 is checked based on a displacement of the connector-insertion detecting jig 54.

Here is set an insertion depth position of each of the terminal-insertion detecting jigs 56 to a position allowing the tip 56*a* of the jig 56 to enter the gap 49*a* between the lance 46 and the cover wall 45*a* in the joint housing JC. Accordingly, as with the first embodiment, the presence or absence of a displacement of each of the terminal-insertion detecting jigs 56 provides an easy determination of an adequacy of the insertion of each of the wire-side terminals 20 in the joint connector JC.

Specifically, when a specific one of the wire-side terminals 20 is incompletely inserted, i.e., a front end of the lance 46 corresponding to the specific wire-side terminal 20 is downwardly deflected, the tip 56*a* of the terminal-insertion detecting jig 56 touch the front end of the lance 46, thus making the lance 46 push the jig 56 to retract it from its original position. On contrast, when the insertion of the wire-side terminal 20 in the joint connector JC is complete, i.e., the lance 46 corresponding to the wire-side terminal 20 is not deflected, the tip 56*a* of the terminal-insertion detecting jig 56 can enter the gap between the lance 46 and the cover wall 45*a*, and therefore the jig 56 is not pushed by the lance 46, with no displacement from the original position.

Thus, in spite of covering the lances 46 from the side of the outer surface thereof by the cover wall 45*a*, an insertion state of the wire-side terminal 20 corresponding to each of the jigs 56 can be determined based on the presence or absence of the displacement of the jig 56.

In the present invention, a plurality of the joint terminals may be held in the single connector housing. For example, in the joint connector JC shown in FIG. 1, a plurality of the joint terminals may be provided in a plurality of rows which are arranged in an direction (in FIG. 1, upward-downward direction) perpendicular to both of a direction of the arrangement of the electric contact portions and an axial direction. This case can be realized, for example, if the lances are formed in both the bottom wall 45 and the top wall 41. Alternatively, the jig insertion spaces may be defined between the joint terminals arranged in the multilevel structure.

The inspection method of the present invention may be collectively performed following the complement of the insertion of all of the wire-side terminals into the joint connector, or may be performed individually following each of the complement of the insertion of each of the wire-side terminals into the joint connector.

As descried above, the present invention provides a joint connector capable of mutually electrically short-circuiting a plurality of wire-side terminals each provided on an end of each of a plurality of electric wires reliably, without an increase in the number of components and in size thereof, and a method of mutually short-circuiting the wires using the joint connector.

Specifically, a joint connector according to the present invention comprises a joint terminal adapted to be connected collectively to the wire-side terminals to mutually short-circuit the wire-side terminals, and a connector housing formed of an insulating material to hold the joint terminal therein. The joint terminal integrally has a plurality of electric contact portions each having a shape contactable with each of the wire-side terminals, the electric contact portions being arranged in a specific direction, and a short-circuiting portion extending in an arrangement direction of the electric contact portions and being connected to each of the electric contact portions. The connector housing has a main body wall surrounding a plurality of terminal insertion spaces into which the wire-side terminals can be inserted respectively so as to contact the respective electric contact portions of the joint terminal inside the connector housing; the body wall is formed with a plurality of terminal locking pieces each having a locking portion capable of being engaged with the wire-side terminal inserted into the terminal insertion space to contact the electric contact portion.

In addition to the above feature, in a joint connector according a first aspect of the present invention, each of the terminal locking pieces has a shape deflectable so as to be retracted from the wire-side terminal perpendicularly to an insertion direction thereof and oppositely to the terminal insertion space, and each position of the terminal locking pieces is set such that: until the wire-side terminal reaches a proper insertion depth position in the terminal insertion space, the terminal locking piece receives a pressing force from the wire-side terminal to be deflected so as to project outwardly from the main body wall, and, when the wire-side terminal reaches the proper insertion depth position, the wire-side terminal is electrically connected to the joint terminal and the terminal locking piece comes back into the main body wall by its elastic returning force.

On the other hand, in a joint connector according to a second aspect of the present invention, the connector housing is further formed to have a jig insertion space permitting the deflection of each of the terminal locking pieces and an insertion of a jig for detecting the deflection into the jig insertion space.

The present invention further provides a method of mutually electrically short-circuiting a plurality of electric wires each having a wire-side terminal provided on an end thereof, by use of the joint connector according to first or second aspect of the present invention: the method comprises a short-circuiting step of inserting the wire-side terminals into respective ones of the terminal insertion spaces defined in the connector housing of the joint connector and bringing the wire-side terminals into contact with corresponding ones of the electric contact portions to mutually short-circuit the wires, and an inspection step of detecting a projection state of the terminal locking pieces from the main body wall of the connector housing following completed insertion of the wire-side terminals and determining an adequacy of the insertion of the wire-side terminal corresponding to each of the terminal locking pieces based on a result of the detection.

In the joint connector according to the first or second aspect of the present invention, each of the terminal locking pieces formed in the main body wall of the connector housing has a function of not only locking a corresponding one of the wire-side terminals inserted into the connector housing but also providing information on whether the wire-side terminal is inserted up to the proper insertion depth position by its deflection due to receiving a pressing force from the wire-side terminal.

For example, in the joint connector according to the first aspect of the present invention, detecting the projection of each of the terminal locking pieces from the main body wall allows an easy determination of an adequacy of the insertion of the wire-side terminal corresponding to the terminal locking piece. In addition, an outer surface of the main body wall formed with the terminal locking pieces may be exposed to the outside, which facilitates the detection of the projection of the terminal locking piece.

In the joint connector according to the second aspect of the present invention, the insertion of the jig into each of the jig insertion spaces defined in the connector housing enables the deflection of the terminal locking piece to be detected from outside of the connector.

More specifically, it is preferable that the connector housing has a cover wall covering the terminal locking pieces in the jig insertion space, from the side of outer surfaces of the terminal locking pieces. This cover wall, while effectively protecting the terminal locking pieces, permits an insertion of an appropriate jig into each of the jig insertion spaces on an inward side of the cover wall, thereby allowing the projection of each of the terminal locking piece to be detected from outside of the connector.

In this case, the connector housing more preferably has a plurality of jig-insertion partition walls partitioning the jig insertion space in one-to-one relation with the terminal locking pieces.

It is more preferable, for the joint connector according to the first or second aspect of the present invention, that the terminal locking piece is positioned so as to begin to be deflected (preferably, the deflection is enough large to be detected by a jig for detecting the deflection) during a period from the start of the insertion of the wire-side terminal into the terminal insertion space to contact of the wire-side terminal with a distal end of the electric contact portion of the joint terminal.

In this joint connector, since the deflection of the terminal locking piece begins before the contact of the wire-side terminal with the electric contact portion, detecting an electrical conduction between the wire-side terminal and the joint terminal enables the insertion state of the wire-side terminal to be accurately determined based on a combination of an result of the detection and a result of the detection of the projection of the terminal locking piece from the main body wall. Specifically, in only the case where the electrical conduction exists and the terminal locking piece is positioned in the main body wall, the wire-side terminal corresponding to the terminal locking piece should be determined to reach the proper insertion depth position.

The invention claimed is:

1. A joint connector for mutually electrically short-circuiting a plurality of wire-side terminals each provided on an end of each of a plurality of electric wires, comprising:

a joint terminal made of an electrically conductive material and adapted to be connected collectively to the wire-side terminals to mutually short-circuit the wire-side terminals; and a connector housing formed of an insulating material to hold the joint terminal in the connector housing, wherein:

the joint terminal integrally has a plurality of electric contact portions each having a shape contactable with each of the wire-side terminals, and arranged in a specific direction, and a short-circuiting portion extending in an arrangement direction of the electric contact portions and connected to the electric contact portions, the connector housing has a main body wall surrounding a plurality of terminal insertion spaces into which the wire-side terminals can be inserted respectively so as to contact the respective electric contact portions of the joint terminal inside the connector housing, the body wall including a bottom wall that has an exposed outer surface exposed to an outside of the joint connector, the bottom wall being formed with a plurality of terminal locking pieces and slits which separate the respective terminal locking pieces from the bottom wall, each of the terminal locking pieces having a locking portion capable of being engaged with the wire-side terminal inserted into the terminal insertion space to contact the electric contact portion, each of the terminal locking pieces forms a part of the exposed outer surface of the bottom wall and has a shape capable of being deflected to be retracted from the wire-side terminal perpendicularly to an intension direction thereof and oppositely to the terminal insertion space, and a position of each of the terminal locking pieces is set such that, until the wire-side terminal reaches a proper insertion depth position in the terminal insertion space, the terminal locking piece is deflected, by a pressing force from the wire-side terminal, so as to project from the bottom wall to the outside of the bottom wall beyond the exposed outer surface of the body wall, and, when the wire-side terminal reaches the proper insertion depth position, the wire-side terminal is electrically connected to the joint terminal and the terminal locking piece comes back into the main body wall by an elastic returning force thereof.

2. The joint connector as defined in claim 1, wherein the terminal locking piece is positioned so as to begin to be deflected during a period from the beginning of the insertion of the wire-side terminal into the terminal insertion space to contact of the wire-side terminal with a distal end of the electric contact portion of the joint terminal.

3. A method of mutually electrically short-circuiting a plurality of electric wires each having a wire-side terminal provided on an end thereof, using the joint connector as defined in claim 1, comprising:

a short-circuiting step of inserting the wire-side terminals into respective ones of the terminal insertion spaces defined in the connector housing of the joint connector and bringing the wire-side terminals into contact with corresponding ones of the electric contact portions to mutually short-circuit the wires; and an inspection step of detecting a projection state of the terminal locking pieces from the main body wall of the connector housing following completed insertion of the wire-side terminals, and determining an adequacy of the insertion of the wire-side terminal corresponding to each of the terminal locking pieces based on a result of the detection.

4. A method of mutually electrically short-circuiting a plurality of electric wires each having a wire-side terminal provided on an end thereof, using the joint connector as defined in claim 1, comprising:

a short-circuiting step of inserting the wire-side terminals into respective ones of the terminal insertion spaces defined in the connector housing of the joint connector and bringing the wire-side terminals into contact with corresponding ones of the electric contact portions to mutually short-circuit the wires; and an inspection step of detecting a projection state of the terminal locking pieces from the main body wall of the connector housing following completed insertion of the wire-side terminals, and determining an adequacy of the insertion of the wire-side terminal corresponding to each of the terminal locking pieces based on a result of the detection, the inspection step including detecting an electrical conduction between each of the wire-side terminals and the joint terminal and determining that the wire-side terminal corresponding to each of the terminal locking pieces reaches the proper insertion depth position in only the case where the electrical conduction exists and the terminal locking piece is not deflected.

* * * * *